US006191095B1

(12) United States Patent
Emery et al.

(10) Patent No.: US 6,191,095 B1
(45) Date of Patent: Feb. 20, 2001

(54) DETERGENT COMPOSITIONS

(75) Inventors: William Derek Emery; Terry Instone, both of Bebington (GB); Seeng Djiang Liem; Gilbert Martin Verschelling, both of Vlaardingen (NL)

(73) Assignee: Lever Brothers Company, a division of Conopco, Inc., New York, NY (US)

( * ) Notice: Under 35 U.S.C. 154(b), the term of this patent shall be extended for 0 days.

(21) Appl. No.: 09/085,070

(22) Filed: May 26, 1998

(30) Foreign Application Priority Data

May 30, 1997 (GB) ..... 9711359

(51) Int. Cl.[7] ..... C11D 3/60; C11D 11/00; C11D 17/06

(52) U.S. Cl. ..... 510/438; 510/276; 510/444; 510/507; 510/512

(58) Field of Search ..... 510/444, 276, 510/507, 512, 438

(56) References Cited

U.S. PATENT DOCUMENTS

| | | | | |
|---|---|---|---|---|
| 4,639,326 | | 1/1987 | Czempik et al. | 252/91 |
| 4,755,318 | * | 7/1988 | Davies et al. | 510/351 |
| 4,820,441 | * | 4/1989 | Evans et al. | 510/452 |
| 4,828,721 | | 5/1989 | Bollier | 252/8.7 |
| 4,861,503 | * | 8/1989 | Hollingsworth et al. | 510/351 |
| 4,900,466 | * | 2/1990 | Atkinson et al. | 510/443 |
| 4,923,628 | | 5/1990 | Appel et al. | 252/135 |
| 5,009,804 | * | 4/1991 | Clayton et al. | 510/299 |
| 5,108,646 | * | 4/1992 | Beerse et al. | 510/532 |
| 5,151,208 | * | 9/1992 | Huijben et al. | 510/452 |
| 5,298,183 | * | 3/1994 | Connor et al. | 510/353 |
| 5,569,645 | | 10/1996 | Dinniwell et al. | 510/276 |
| 5,707,959 | * | 1/1998 | Pancheri et al. | 510/444 |
| 5,726,142 | * | 3/1998 | Partee et al. | 510/276 |

FOREIGN PATENT DOCUMENTS

| | | | |
|---|---|---|---|
| 1070210 | | 1/1980 | (CA) . |
| 2 050 560 | | 4/1971 | (DE) . |
| 164 514 | | 12/1985 | (EP) . |
| 168 102 | | 1/1986 | (EP) . |
| 220 024 | | 4/1987 | (EP) . |
| 221 776 | | 5/1987 | (EP) . |
| 242 138 | | 10/1987 | (EP) . |
| 266 863 | | 5/1988 | (EP) . |
| 289 311 | | 11/1988 | (EP) . |
| 289 312 | | 11/1988 | (EP) . |
| 289 313 | | 11/1988 | (EP) . |
| 341 072 | | 11/1989 | (EP) . |
| 342 043 | | 11/1989 | (EP) . |
| 0352135 | * | 1/1990 | (EP) . |
| 351 937 | | 1/1990 | (EP) . |
| 228 011 | | 4/1990 | (EP) . |
| 367 339 | | 5/1990 | (EP) . |
| 384 070 | | 8/1990 | (EP) . |

(List continued on next page.)

OTHER PUBLICATIONS

Derwent abstract of JP 8027498, Jan. 30, 1996.
Derwent abstract of JP 7268398, Oct. 17, 1995.
Derwent abstract of JP 7197084, Aug. 1, 1995.
Derwent abstract of JP 6179892, Jun. 23, 1994.
Derwent abstract of DE 3131668 dated Mar. 11, 1982 with Miyazaki et al., U.S. 4,405,484.
Derwent abstract of PCT patent application WO 96/23864, Aug. 8, 1996.
Derwent abstract of European patent application EP 219 328, Apr. 22, 1987.
Derwent abstract of European patent application EP 168 102, Jan. 15, 1986.
Derwent abstract of German patent application DE 4229660, Mar. 10, 1994.
Derwent abstract of German patent application DE 3545947, Jul. 2, 1987.
Derwent abstract of German patent application DE 3424299, Jan. 9, 1986.
Derwent abstract of German patent application DE 19601841, Jul. 24, 1997.
Derwent abstract of Japanese patent application JP 4363400, Dec. 16, 1992.
Derwent abstract of Japanese patent application JP 7011293, Jan. 13, 1995.
Derwent abstract of Japanese patent application JP 7286195, Oct. 31, 1995.
Derwent abstract of Japanese patent application JP 7286196, Oct. 31, 1995.
Derwent abstract of Japanese patent application JP 7286197, Oct. 31, 1995.
Derwent abstract of Japanese patent application JP 7286198, Oct. 31, 1995.
Derwent abstract of Japanese patent application JP 7258693, Oct. 9, 1995.
Derwent abstract of Japanese patent application JP 7268397, Oct. 17, 1995.
Derwent abstract of Japanese patent application JP 7268399, Oct. 17, 1995.
Derwent abstract of Japanese patent application JP 7268400, Oct. 17, 1995.
Derwent abstract of Japanese patent application JP 8003600, Jan. 9, 1996.
Derwent abstract of JP 09 095694, Apr. 8, 1997.
Derwent abstract of JP 03084100, Apr. 9, 1991.

*Primary Examiner*—Lorna M. Douyon
(74) *Attorney, Agent, or Firm*—Rimma Mitelman

(57) ABSTRACT

A particulate detergent composition having a bulk density of 700 g/l or less and containing at least 10 wt % (preferably at least 15 wt %) of organic detergent surfactant comprises a base powder composed of at least two granular components. Less than 80% by weight, preferably less than 66% by weight, of the base powder has a compressibility (measured at 20–25° C. and about 40% relative humidity) of 17% or more. Preferably one of the components of the base powder is a granule containing a high level (at least 60 wt %) of anionic surfactant.

15 Claims, No Drawings

FOREIGN PATENT DOCUMENTS

| | | | |
|---|---|---|---|
| 390 251 | | 10/1990 | (EP) . |
| 390 287 | | 10/1990 | (EP) . |
| 420 317 | | 4/1991 | (EP) . |
| 425 277 | | 5/1991 | (EP) . |
| 430 328 | | 6/1991 | (EP) . |
| 0438320 | * | 7/1991 | (EP) . |
| 451 894 | | 10/1991 | (EP) . |
| 477 974 | | 4/1992 | (EP) . |
| 534 525 | | 9/1992 | (EP) . |
| 521 635 | | 1/1993 | (EP) . |
| 550 086 | | 7/1993 | (EP) . |
| 560 395 | | 9/1993 | (EP) . |
| 562 628 | | 9/1993 | (EP) . |
| 593 014 | | 4/1994 | (EP) . |
| 618 290 | | 5/1994 | (EP) . |
| 639 637 | | 2/1995 | (EP) . |
| 639 639 | | 2/1995 | (EP) . |
| 643 130 | | 3/1995 | (EP) . |
| 653 481 | | 5/1995 | (EP) . |
| 2 356 718 | | 1/1978 | (FR) . |
| 1303479 | | 1/1973 | (GB) . |
| 1 470 250 | | 4/1977 | (GB) . |
| 1 473 202 | | 5/1977 | (GB) . |
| 2 123 044 | | 1/1984 | (GB) . |
| 2 301 835 | | 12/1996 | (GB) . |
| 2 304 726 | | 3/1997 | (GB) . |
| 8-027498 | | 1/1996 | (JP) . |
| 92/07060 | | 4/1992 | (WO) . |
| 93/02168 | | 2/1993 | (WO) . |
| 93/18124 | | 9/1993 | (WO) . |
| 93/20172 | | 10/1993 | (WO) . |
| 94/01521 | | 1/1994 | (WO) . |
| 95/02682 | | 1/1995 | (WO) . |
| 96/34084 | | 10/1995 | (WO) . |
| 96/06916 | | 3/1996 | (WO) . |
| 96/06917 | | 3/1996 | (WO) . |
| 96/10070 | | 4/1996 | (WO) . |
| 96/22355 | | 7/1996 | (WO) . |
| 96/38529 | | 12/1996 | (WO) . |
| 96/38530 | | 12/1996 | (WO) . |
| 97/32002 | | 9/1997 | (WO) . |
| 97/32005 | | 9/1997 | (WO) . |

* cited by examiner

DETERGENT COMPOSITIONS

TECHNICAL FIELD

The present invention relates to a medium to low bulk density particulate detergent composition.

BACKGROUND

Particulate detergent compositions of medium to low bulk density may be manufactured by the spray-drying process, or by agglomeration in low shear mixers such as a fluidised bed, or pan granulator and may be used as a "base powder" for a detergent composition. In the spray-drying process, a slurry of components such as anionic detergent active, builder material and optionally nonionic detergent active is manufactured and then dried by spraying it in atomised form into a co- or countercurrent stream of air at high temperature. The resultant particulate compositions may be used directly as a detergent composition or other components can be post-dosed, for example heat or moisture sensitive components, to provide a complete powder composition. The spray-dried granules are found in practice to have bulk densities less than 600 g/l, but the postdosed components may raise the bulk density of the composition to around 700 g/l.

Such low to medium bulk density detergent compositions can be sticky particularly in moist environments and particularly where they have a moderate to high content of organic detergent surfactant. Moderate to high quantities of anionic surfactant can give particular problems. This can make them difficult to handle and process, as they become less free-flowing and tend to form lumps. Such compositions may also have poor storage stability, tending to form cakes on storage, leading to poor product quality.

Particulate composition flow properties can be measured for example by dynamic flow rate and/or the compressibility. Compressibility can be measured by the tests described below. High compressibilities imply poor flow properties. Compositions having in excess of 10% by weight of organic detergent surfactant generally have a compressibility in the range of 20 to 25%. The compressibility of such compositions can under certain conditions be reduced to just above 17%, but further reduction is very difficult without reducing the surfactant level.

SUMMARY OF THE INVENTION

It is an object of the present invention to provide a particulate detergent composition having a medium to low bulk density (preferably a bulk density of less than 700 g/l, more preferably less than 600 g/l ) and a moderate to high organic detergent surfactant content (preferably at least 10% by weight, more preferably at least 15% by weight and especially at least 20% by weight) and which has improved properties such as lower stickiness, improved storage stability and lower caking tendency.

It is further desired to reduce the compressibility of the detergent composition without reducing the content of organic surfactant. It is further desired that the particulate detergent composition should retain its improved properties even in conditions of increase ambient temperature and humidity.

The inventors have discovered that, if at least a proportion of the base powder is reformulated so that its compressibility is below 17%, the properties of the detergent composition can be improved.

Here, the term "base powder" is used to signify granular components manufactured by spray-drying or spray-drying followed by densification or manufactured by agglomeration. The base powder comprises structured particles containing detergent active and builder which form the base of any detergent composition.

It has been found by the inventors that improved properties can be obtained if the quantity of the base powder having a compressibility above a certain value is kept at a low level. In the present invention, compressibility is measured by compressing a known volume of particulate detergent composition by application of a standard weight, at defined conditions of temperature and humidity, after which the volume reduction is noted. The method used in the invention is described further below.

Accordingly, the present invention provides a particulate detergent composition having a bulk density of 700 g/l or less and comprising a base powder, the composition comprising builder and at least 10% by weight of organic detergent surfactant, characterised in that less than 80% by weight, preferably less than 66% by weight, of the base powder has a compressibility (measured as described below at 20–25° C. and about 40% relative humidity) of 17% or more.

A base powder of the present invention will comprise particulate composition comprising builder and detergent surfactant selected from anionic surfactant, nonionic surfactant or mixtures thereof. The base powder may include other components as discussed below.

According to the present invention, the base powder will comprise at least two different components. At least one of these components will have a compressibility below 17%. As will be described further below, any given component of the base powder may not include both detergent active and builder, but the base powder as a whole will.

More particularly, therefore, the present invention provides a particulate detergent composition having a bulk density of 700 g/l or less and comprising at least 10 wt % of organic detergent surfactant, the composition comprising a base powder which contains detergency builder and organic detergent surfactant selected from anionic surfactant, nonionic surfactant and mixtures thereof and which consists of structured particles, characterised in that the base powder is composed of at least two different granular components, and at least one of these components has a compressibility (measured at 20–25° C. and about 40% relative humidity) of less than 17%, whereby less than 80% by weight, preferably less than 66% by weight, of the total base powder has a compressibility of 17% or more.

As previously indicated, the composition preferably contains at least 15% by weight of detergent surfactant. The invention is of especial interest as a means for formulating compositions containing very high levels of detergent surfactant, for example, at least 20% by weight.

The base powder preferably comprises granules having an average particle size of greater than 200 micrometers.

The invention further provides a process for manufacturing a particulate detergent composition as defined above, comprising separately preparing granular components and dry-mixing the granular components.

Compressibility

The method of measuring compressibility used in the present invention is as follows.

The experiment is carried out at 20–25° C. and a relative humidity of about 40%. These values represent typical ambient conditions in a northern European indoor laboratory environment. The exact relative humidity at which the measurement is carried out is not critical, provided that it is not so high that the samples take up moisture.

The apparatus comprises a perspex cylinder with an internal diameter of 54 mm and a height of 170 mm. The side of the cylinder is graduated in millimeters. A piston is provided which fits the internal diameter of the perspex cylinder.

The top of the piston has means to support a weight, whereby pressure can be applied to detergent powder contained in the perspex cylinder. The combined mass of the piston and the weight is 25 kg.

To measure the compressibility of a sample, the perspex cylinder is filled with particulate detergent composition (herein after "powder"). The top of the layer of powder is levelled by removing superfluous powder with a straightedge. Thus, a standard volume of powder is tested. The initial volume is measured by means of the scale on the side of the cylinder. The piston and weight are then lowered onto the surface of the powder and are allowed to rest freely on the powder for 60 seconds. The volume of the powder after 60 seconds is measured by means of the scale on the side of the cylinder.

The volume reduction is used to calculate the compressibility using the following equation:

$$\underset{(\text{in }\%)}{\text{Compressibility}} = \frac{(\text{initial volume} - \text{final volume})}{\text{initial volume}} \times 100$$

Components having a compressibility of 17% or more can lead to stickiness or storage problems if present at too high a level. According to the invention, less than 66% by weight of the base powder, preferably less than 50% by weight, more preferably less than 45% by weight and most preferably less than 35% by weight, of the base powder, has a compressibility of 17% or more.

Granular Base Powder Components

Granular components for use in the detergent composition of the present invention may be manufactured by any suitable process. For example, they may be produced by spray-drying, spray-drying followed by densification in a batch or continuous high speed mixer/densifier or by a wholly non-tower route comprising granulation of components in a mixer/densifier, preferably in a low shear mixer/densifier such as a pan granulator or fluidised bed mixer. Methods of manufacturing a high anionic detergent active granular component are also discussed below.

The separately produced granular components may be dry-mixed together in any suitable apparatus.

The bulk density of the granular components may be any suitable bulk density as long as the bulk density of the finished detergent composition does not exceed 700 g/l. The bulk density of the particulate detergent composition is preferably less than 650 g/l, more preferably less than 600 g/l, most preferably less than 550 g/l.

The inventors have sought ways of reducing the compressibility of granular components of the base powder or reducing the quantity of high compressibility granular component. The following methods may be used. The quantity of organic detergent surfactant in a granular component may be decreased. In order to maintain the level of surfactant in the detergent composition as a whole, an additional granular component having a high organic detergent surfactant level may also be required. The active (surfactant) level in such a component may be 60% by weight or more.

The high active granular component may comprise a spray dried or agglomerated component having a large quantity of anionic and/or nonionic surfactant. Such a component may have considerable problems of stickiness, poor storage stability and caking. However, the inventors have found that, where a given formulation of detergent composition is produced by dry-mixing at least two granular components having different active levels, the detergent composition has better properties such as stability and stickiness than if the formulation were produced with all the components in a single granule.

Accordingly, according to an embodiment of the present invention, the base powder composition comprises at least two granular components, a first component having a compressibility as herein defined of 17% or more and a second component having a compressibility as herein defined of less than 17%, there being less than 80% by weight, preferably less than 66% by weight, of the first component.

The inventors have further discovered that particles having a very high quantity of anionic surfactant can have a compressibility which is less than 17%. Accordingly, according to a further preferred embodiment of the invention, the detergent composition comprises at least one granular component having an anionic surfactant content of at least, preferably in excess of, 60% by weight.

High-active Anionic Surfactant Granules

A method of producing a detergent component having at least 60% by weight of anionic surfactant is set forth in WO 97/32002A (Unilever). The process comprises the steps of feeding a paste material comprising water and an anionic surfactant or a mixture of acid surfactant precursor and neutralising agent into a drying zone, heating the material in the drying zone to reduce the water content thereof and subsequently cooling the material in a cooling zone to form detergent component particles, characterised by introducing a layering agent into the cooling zone during the cooling step. This process may be carried out in a machine manufactured by VRV Impianti SpA, having a heating surface area of 1.2 $m^2$. The heating zones are maintained at a temperature in the region of 120–190° C., for example 170° C. Cooling is achieved using ambient process water at 15° C. The apparatus is preferably used with tip speed of the blades of 30 m/s.

A method of producing a detergent component having at least 75% by weight of anionic surfactant is set forth in WO 96/06916A and WO 96/06917A (Unilever). In this process, a paste material comprising water in an amount of more than 10% by weight of the paste and the surfactant is fed into a drying zone, the paste is heated to a temperature in excess of 130° C. to reduce the water content to not more than 10% by weight and the material is subsequently cooled to form detergent component particles.

The compressibility of the particles produced by the methods described above will depend to a certain extent on the anionic surfactant used. The compressibility may be further controlled by controlling the final water content of the particles produced and the temperature at which they are dried.

Nonionic Surfactant Granules

The base powder may also comprise granules having a high quantity of nonionic surfactant. These granules preferably contain at least 40% by weight, more preferably at least 50% by weight, of nonionic surfactant. Preferred nonionic surfactants are listed below under "Detergent Ingredients".

A method for producing a particle containing a high quantity of nonionic surfactant is set out, for example in EP 560395A (Lion).

Detergent compositions comprising nonionic-surfactant-containing granules comprising 55% by weight or more of nonionic surfactant, at least 5% by weight silica of oil absorption capacity of 1.0 ml/g and less than 10% by weight of aluminosilicate may be used. These granules can be manufactured by mixing together the components in a high-speed granulator, for example, an Eirich RVO2 granulator. Alternatively, 70–100% by weight of the solid components and 70–95% by weight of the nonionic surfactant can be mixed together in a first step, the remainder of the solid components and nonionic surfactant being added in a second step, preferably under moderate shear. Structurants such as soap or polyethylene glycol can be included in these granules to give strength, at a level of from 2 to 15% by weight. In the second process, the majority of structurant is added in the second step.

The compressibility of nonionic surfactant containing particles produced by this method is in the region of 15 to 25%.

Builder Granules

The base powder may comprise granules having a high quantity of builder, the granules containing for example at least 70% by weight builder, preferably at least 80% by weight. Especially preferred compositions in accordance with the invention are built with sodium tripolyphosphate, zeolite or a mixture of the two. Preferred builders are listed below in more detail under "Detergent Ingredients".

The compositions of the invention may comprise granules containing mixed builder and anionic surfactant, postdosed powder components, or mixtures thereof.

Builder granules are available commercially.

Postdosed Ingredients

The detergent composition of the present invention may consist wholly of the base powder. In this form, the base powder may provide a complete detergent composition for use in fabric washing. The detergent composition may alternatively include additional powdered components which are dry-mixed with the base powder. Suitable components which may be postdosed to the base powder will be discussed further below under "Detergent Ingredients".

Where such postdosed ingredients are present, it is preferred that the total composition contains less than 55% by weight, preferably less than 50% by weight, more preferably less than 45% by weight and most preferably less than 40% by weight, of components having compressibilities of 17% or more, taking postdosed ingredients into account.

Preferably, the base powder, ie the granular components taken together, provides at least 40% by weight, preferably at least 50% by weight of the total composition.

The compositions of the present invention, whether or not postdosed ingredients are present, preferably have a compressibility of less than 20%.

Detergent Ingredients

The detergent compositions of the invention will contain, as essential ingredients, one or more detergent active compounds (surfactants) which may be chosen from soap and non-soap anionic, cationic, nonionic, amphoteric and zwitterionic detergent active compounds, and mixtures thereof.

Many suitable detergent active compounds are available and are fully described in the literature, for example, in "Surface-Active Agents and Detergents", Volumes I and II, by Schwartz, Perry and Berch.

The preferred detergent active compounds that can be used are soaps and synthetic non-soap anionic and nonionic compounds.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{15}$ primary alkyl sulphates; alkyl ether sulphates; olefin sulphonates; alkyl xylene sulphonates; dialkyl sulphosuccinates; and fatty acid estersulphonates. Sodium salts are generally preferred.

Preferably, the quantity of anionic surfactant in the total composition is in the range of from 5 to 50% by weight, more preferably 5 to 40% by weight. Of especial interest are formulations containing at least 10% by weight, and more especially at least 15% by weight, of anionic surfactant.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

As previously indicated, the total quantity of organic detergent surfactant must be at least 10% by weight, preferably at least 12% by weight, more preferably at least 15% by weight. Compositions of very high surfactant content, for example, at least 20% by weight, are of especial interest.

There may only be anionic surfactant and no nonionic surfactant or vice versa. If both are present, preferably the weight ratio of anionic surfactant to nonionic surfactant is within the range of from 3:1 to 1:3.

The detergent compositions of the invention also contain one or more detergency builders. The total amount of detergency builder in the compositions will suitably range from 5 to 80% by weight, preferably from 10 to 60% by weight. Builders are normally wholly or predominantly included in the granular components (base powder). Builder-containing granular components may suitably contain less than 5% by weight of detergent surfactant, and preferably substantially no detergent surfactant.

As indicated, the most preferred builders according to the present invention are sodium tripolyphosphate, and zeolite (crystalline aluminosilicate).

Crystalline aluminosilicate builders are preferably alkali metal aluminosilicates, and more preferably sodium aluminosilicates. The aluminosilicate may generally be incorporated in amounts of from 10 to 70% by weight anhydrous basis), preferably from 25 to 50% by weight.

Aluminosilicates are materials having the general formula:

$$0.8\text{–}1.5\ M_2O.\ Al_2O_3.\ 0.8\text{–}6\ SiO_2$$

where M is a monovalent cation, preferably sodium. These materials contain some bound water and are required to have a calcium ion exchange capacity of at least 50 mg CaO/g. The preferred sodium aluminosilicates contain 1.5–3.5 $SiO_2$ units in the formula above. They can be prepared readily by reaction between sodium silicate and sodium aluminate, as amply described in the literature.

The zeolite used in the compositions of the present invention may be the commercially available zeolite A (zeolite 4A) now widely used in laundry detergent powders. However, according to a preferred embodiment of the invention, the zeolite incorporated in the compositions of the invention is maximum aluminium zeolite P (zeolite MAP) as described and claimed in EP 384 070B (Unilever), and commercially available as Doucil (Trade Mark) A24 from Crosfield Chemicals Ltd, UK.

Zeolite MAP is defined as an alkali metal aluminosilicate of zeolite P type having a silicon to aluminium ratio not exceeding 1.33, preferably within the range of from 0.90 to 1.33, preferably within the range of from 0.90 to 1.20. Especially preferred is zeolite MAP having a silicon to aluminium ratio not exceeding 1.07, more preferably about 1.00. the calcium binding capacity of zeolite MAP is generally at least 150 mg CaO per g of anhydrous material.

As well as the crystalline aluminosilicate builders already mentioned, other inorganic or organic builders may be present. Inorganic builders that may be present include sodium carbonate, layered silicates (eg SKS-6 from Hoechst), amorphous aluminosilicates, and phosphate builders, for example, sodium orthophosphate, pyrophosphate and tripolyphosphate.

Organic builders that may additionally be present include polycarboxylate polymers such as polyacrylates and acrylic/maleic copolymers; monomeric polycarboxylates such as citrates, gluconates, oxydisuccinates, glycerol mono-di- and trisuccinates, carboxymethyloxysuccinates, carboxymethyloxymalonates, dipicolinates, hydroxyethyliminodiacetates, alkyl- and alkyenylmalonates and succinates; and sulphonated fatty acid salts.

Especially preferred organic builders are citrates, suitably used in amounts of from 5 to 30 wt %, preferably from 10 to 25 wt %; and acrylic polymers, more especially acrylic/maleic copolymers, suitably used in amounts of from 0.5 to 15 wt %, preferably from 1 to 10 wt %.

Builders, both inorganic and organic, are preferably present in alkali metal salt, especially sodium salt, form.

Detergent compositions according to the invention may also suitably contain a bleach system. It is preferred that the compositions of the invention contain peroxy bleach compounds capable of yielding hydrogen peroxide in aqueous solution, for example inorganic or organic peroxyacids, and inorganic persalts such as the alkali metal perborates, percarbonates, perphosphates, persilicates and persulphates. Bleach ingredients are generally post-dosed as powders.

Sodium percarbonate may have a protective coating against destabilisation by moisture. Sodium percarbonate having a protective coating comprising sodium metaborate and sodium silicate is disclosed in GB 2 123 044 (Kao).

The peroxy bleach compound, for example sodium percarbonate, is suitably present in an amount of from 5 to 35 wt %, preferably from 10 to 25 wt %.

The peroxy bleach compound, for example sodium percarbonate, may be used in conjunction with a bleach activator (bleach precursor) to improve bleaching action at low wash temperatures. The bleach precursor is suitably present in an amount of from 1 to 8 wt %, preferably from 2 to 5 wt %.

Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N, N, N', N'-tetracetyl ethylenediamine (TAED).

A bleach stabiliser (heavy metal sequestrant) may also be present. Suitable bleach stabilisers include ethylenediamine tetraacetate (EDTA), ethylenediamine disuccinate (EDDS), and the aminopolyphosphonates such as ethylenediamine tetramethylene phosphonate (EDTMP) and diethylenetriamine pentamethylene phosphonate (DETPMP).

The composition of the present invention may also include bleach catalysts. For example, manganese cyclononane derivatives may be included.

The compositions of the present invention may also contain soil release polymers, for example sulphonated and unsulphonated PET/POET polymers, both end-capped and non-end-capped, and polyethylene glycol/polyvinyl alcohol graft copolymers such as Sokalan (Trade Mark) HP22.

The compositions of the invention may also contain dye transfer inhibiting polymers, for example, polyvinyl pyrrolidone (PVP), vinyl pyrrolidone copolymers such as PVP/PVI, polyamine-N-oxides, PVP-NO etc.

The compositions of the invention may also contain alkali metal, preferably sodium, carbonate, in order to increase detergency and ease processing. Sodium carbonate may suitably be present in amounts ranging from 1 to 60% by weight, preferably from 2 to 40% by weight. However, compositions containing little or no sodium carbonate are also within the scope of the invention. Sodium carbonate may be included in granular components, or postdosed, or both.

The detergent composition may contain water-soluble crystalline or amorphous alkali metal silicate, preferably sodium silicate having a $SiO_2$:$Na_2O$ mole ratio within the range of from 1.6:1 to 4:1, most preferably 2:1 to 3.3:1.

The water-soluble silicate may be present in an amount of from 1 to 20 wt %, preferably 3 to 15 wt % and more preferably 5 to 10 wt %, based on the aluminosilicate (anhydrous basis).

A small amount of a powder structurant, for example, a fatty acid (or fatty acid soap), a sugar, an acrylate or acrylate/maleate polymer, may be included in the base powder components. A preferred powder structurant is fatty acid soap, suitably present in an amount of from 1 to 5% by weight.

Other materials that may be present in detergent compositions of the invention include antiredeposition agents such as cellulosic polymers; fluorescers; photobleaches; inorganic salts such as sodium sulphate; foam control agents or foam boosters as appropriate; enzymes (proteases, lipases, amylases, cellulases); dyes; colored speckles; perfumes; and fabric conditioning compounds.

Ingredients which are normally but not exclusively postdosed, may include bleach ingredients, bleach precursor, bleach catalyst, bleach stabiliser, photobleaches, alkali metal carbonate, water-soluble crystalline or amorphous alkaline metal silicate, layered silicates, antiredeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

The invention is further illustrated by the following non-limiting Examples.

EXAMPLES

In the following examples, the compressibility of powders is measured by the technique described above.

The dynamic flow-rate or DFR is measured by the following method.

The apparatus used consists of a cylindrical glass tube having an internal diameter of 35 mm and a length of 600 mm. The tube is securely champed in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow-rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time t (seconds) taken for the powder level to fall from the upper sensor to the lower sensor is measured electronically. The measurement is normally repeated two or three times and an average value taken. If V is the volume (ml) of the tube between the upper and lower sensors, the dynamic flow rate DFR (ml/s) is given by the following equation:

$$DFR=V/t$$

The averaging and calculation are carried out electronically and a direct read-out of the DFR value obtained.

In the Examples, all quantities of components are in parts or percentages by weight unless stated otherwise.

Preparation of Granular Components

The following powder components were prepared by spray-drying. F1–F4 were typical detergent base powders containing substantial levels of builder, anionic surfactant and nonionic surfactant. B1–B3 were builder granules.

| Component | F1 | F2 | F3 | F4 | B1 | B2 | B3 |
|---|---|---|---|---|---|---|---|
| STP | | 40.3 | | | 76.2 | | |
| Zeolite MAP (anh) | | | | | | | 76.7 |
| Zeolite 4A (anh) | 39.5 | | 30.2 | 36.9 | | | |
| Sodium silicate | 0.7 | 10.6 | 0.5 | 9.8 | 10.6 | 10.0 | |
| Sokalan CP5 ex BASF | 4.9 | 1.9 | 3.6 | 1.8 | | | 9.8 |
| Sodium sulphate | | 6.0 | 20.0 | 24.6 | | | |
| Sodium carbonate | 13.7 | | 20.6 | | | 85.0 | |
| NaLAS[1] | 20.3 | 10.6 | 8.2 | 10.0 | 2.2 | 2.0 | 2.6 |
| Synperonic A7[2] | 5.1 | 7.1 | 6.1 | 4.9 | | | |
| Synperonic A3[2] | | 5.3 | | | | | |
| Sodium carboxymethyl cellulose | 0.7 | 0.7 | | | | | |
| Salts, NDOM | 15.1 | 17.5 | 11.0 | 12.0 | 11.0 | 3.0 | 10.9 |
| Water | | | | | | | |

[1]Sodium linear alkyl benzene sulphonate produced by neutralisation of Dobanic Acid 103 ex Shell.
[2]Nonionic surfactants ex ICI.

Granular components A1, A2 and A3 containing high levels of anionic surfactant were prepared by non-spray-drying processes as follows.

For component A2, sodium primary alcohol sulphate particles (NaPAS) were manufactured from a paste containing 70% neutralised cocoPAS and 30% water, dried in a dryer/granulator supplied by VRV SpA, Italy.

The temperature of the material entering the drying zone was set at 60° C. and a small negative pressure was applied to the drying zone. A throughput in the flash drier of 120 kg/hr of paste was used. The temperature of the wall of the drying zone was initially 140° C. The heat transfer area of the drying and cooling zones was 10 $m^2$ and 5 $m^2$ respectively. The temperature of the wall of the drying zone was raised in steps to 170° C. Correspondingly, the throughput was increased in steps to 430 kg/hr at 170° C. At each step, the process conditions were stabilised for 15 minutes. The particles then passed to a cooling zone operated at a temperature of 30° C.

For component A1, sodium linear alkyl benzene sulphonate particles (NaLAS) were produced by neutralising LAS acid with sodium carbonate. Furthermore, zeolite MAP was dosed as a layering agent and optionally sodium sulphate was dosed as well. A 1.2 $m^2$ VRV flash-drier machine was used having three equal jacket sections. Dosing ports for liquids and powders were situated just prior to the first hot section, with mid-jacket dosing ports available in the final two sections. Zeolite was added via this port in the final section. An electrically-powered oil heater provided the heating to the first two jacket sections. Ambient process water at 15° C. was used for cooling the jacket in the final section. Make-up air flow through the reactor was controlled between 10 and 50 $m^3$/kg hr by opening a bypass on the exhaust vapour extraction fan. All experiments were carried out with the motor at full-speed giving a tip speed of about 30 m/s. Screw-feeders were calibrated to dose sodium carbonate and zeolite MAP for layering. The sodium carbonate and liquids were added just prior to the first hot section and zeolite layering was added into the third section which was cold. The minimum level of zeolite was added to give free-flowing granules leaving the drier. A jacket temperature of 145° C. was used in the first two sections, with an estimated throughput of components 60 to 100 kg/hr. A degree of neutralisation of alkyl benzene sulphonate of greater than 95 was achieved. The bulk density, surfactant level and compressibility of the particles was then measured.

Alpha-olefin sulphonate (AOS) granules A3 were produced in a similar manner by drying an AOS paste containing 70% neutralised AOS and 30% water in a dryer/granulator supplied by VRV SpA, Italy. The temperature of the material fed into the drying zone was set at 60° C. and a small negative pressure was applied to the drying zone. The temperature of the wall of the drying zone was initially 140° C. The heat transfer areas of the drying and cooling zones were 0.8 $m^2$ and 0.4 $m^2$ respectively. The temperature of the wall of the drying zone was raised in steps to 155° C. The particles then passed to a cooling zone operated at a temperature of 30° C. and were collected as free flowing granules.

The anionic surfactant granules had the following compositions:

| Component | A1 | A2 | A3 |
|---|---|---|---|
| Na PAS | | 90 | |
| Na LAS | 81 | | |
| Na AOS | | | 96 |
| Zeolite 4A | 10 | | |
| Sodium carbonate | 5 | | |
| Water | 2 | 5 | ) 4 |
| Salts, NDOM | 3 | 5 | ) |

A granular component N1 containing nonionic surfactant was manufactured by the following process.

A mixture of sodium sulphate, sodium carbonate and Sokalan (Trade Mark) CP5 (acrylic/maleic copolymer ex BASF, Na salt) was spray-dried to form a porous carrier powder of the formulation given below. The slurry was made by successively dosing Sokalan CP5, sodium sulphate and sodium carbonate in water. The moisture content of the slurry was 55% at a temperature 90° C. The slurry was sprayed in a counter-current spray-drying tower using an inlet temperature of 350–400° C.

Nonionic surfactant was sprayed into this spray-dried carrier in a rotating pan-granulator, resulting in the following final composition N1.

| Ingredients | Carrier | N1 |
|---|---|---|
| Sodium sulphate | 64.2 | 45.8 |
| Sodium carbonate | 24 | 17.1 |
| Sokalan CP5 | 9.8 | 7.0 |
| Water | 2.0 | 1.4 |
| Synperonic A7 | — | 28.7 |

A second nonionic surfactant granule N2 was manufactured by the following procedure.

Silica (Sorbosil TC15 ex Crosfield) was dosed into a Fukae FS30 granulator and a mixture of nonionic surfactant (Synperonic 7 supplied by ICI) and Pristerene 4916 (fatty acid supplied by Unichema) at a temperature of approximately 60° C. was added on top of the solid. Thereafter, 50% sodium hydroxide solution was sprinkled on top. Directly after addition of the sodium hydroxide, the mixture was granulated using an aggitator speed of 200 rpm and a chopper speed of 3000 rpm. Granulation time was in the region 30–60 seconds. The resulting powder was layered with silica and removed from the granulator. The composition was as follows:

| | N2 |
|---|---|
| Silica (Sorbosil TC15) | 26.1 |
| Synperonic A7 | 64.7 |
| Soap | 7.8 |
| Water | 1.4 |

The properties of the various granules are as shown in the following Table.

| Components | BD [g/l] | Surfactant level [%] | Compressibility [%] |
|---|---|---|---|
| F1 | 433 | 25 | 22 |
| F2 | 488 | 23 | 20 |
| F3 | 404 | 15 | 17 |
| F4 | 458 | 14.5 | 23 |
| B1 | 550 | 2 | 5.5 |
| B2 | 329 | 2 | 3.5 |
| B3 | 370 | 2 | 7 |
| A1 | 636 | 81 | 19 |
| A2 | 550 | 90 | 12 |
| A3 | 550 | 96 | 15 |
| N1 | 501 | 27.1 | 8 |
| N2 | 587 | 65 | 22 |

With a selection of the above components, detergent base powders having the following compositions were prepared in a V-blender by addition of the various powders followed by 5 minutes mixing. The powder properties are shown in the following Tables.

Examples 1–3, Comparative Example A

Sodium tripolyphosphate built compositions having a medium surfactant level were manufactured by blending the following components. All four compositions had the same final composition (ie that of base powder F2).

| Component | A | 1 | 2 | 3 |
|---|---|---|---|---|
| F2 | 100 | | | |
| B1 | | 31.8 | 47.8 | 52.9 |
| B2 | | | | 8.8 |
| A1 | | 14.8 | 10.4 | 11.7 |
| N1 | | 53.4 | 41.7 | |
| N2 | | | | 19.2 |
| Na sulphate | | | | 7.4 |
| Surfactant [%] | 23 | 27 | 21 | 23 |
| STP level [%] | 40 | 24 | 37 | 40 |
| BD [g/l] | 488 | 532 | 523 | 549 |
| DFR [ml/s] | 93 | 95 | 94 | 101 |
| Compressibility | 20 | 8 | 6 | 11 |
| High compress. material in base (% wt) | 100 | 14.8 | 10.4 | 33.4 |
| High compress. material in whole powder (% wt) | 100 | 14.8 | 10.4 | 30.9 |

The compressibility of compositions 1, 2 and 3 according to the invention is clearly lower than the comparative powder A. Furthermore, even with much reduced STP levels, such as in composition 1, much improved properties are found.

Example 4 and Comparative Example B

Zeolite-built compositions as shown in the following table, having a medium surfactant level, were manufactured by dry-mixing the components. The two compositions had the same final formulation.

The antifoam granule contained 70 wt % sodium carbonate, 18 wt % silicone oil and 12 wt % filler materials.

Example 4 according to the invention, in which the base powder has been reformulated to include components of compressibility less than 17%, provides a lower compressibility and higher DFR than a comparative conventional formulation B.

| Component | B | 4 |
|---|---|---|
| F1 | 94.8 | |
| B3 | | 46.5 |
| B2 | | 7.3 |
| N1 | | 18.1 |
| A1 | | 22.4 |
| Antifoam granule | 1.3 | 1.3 |
| Sodium bicarbonate | 3.9 | 3.9 |
| SCMC | | 0.6 |
| BD [g/l] | 449 | 469 |
| DFR [ml/s] | 91 | 102 |
| Compressibility [%] | 22 | 10 |
| Surfactant level [%] | 23.7 | 24.4 |
| High compessibility material in base [%] | 100 | 23.7 |
| High compressibility material in total [%] | 94.8 | 23.7 |

Examples 5 and 6, Comparative Example C

These Examples show how formulations containing very high surfactant levels and excellent powder properties can be prepared by "topping up" a base powder having a medium surfactant level with a high-active granule, without loss of powder properties.

Two more spray-dried base powders F5 and F6 were prepared by spray-drying to the following formulations.

| Component | F5 | F6 |
|---|---|---|
| NaLAS | 37.10 | 26.34 |
| STP | 22.91 | 26.94 |
| Sodium sulphate | 16.18 | 18.97 |
| Silicate | 14.30 | 16.85 |
| SCMC | 0.58 | 0.69 |
| Water | 7.50 | 9.10 |
| Miscellaneous | 1.41 | 1.11 |
| BD [g/l] | 328 | 346 |
| DFR [ml/s] | 112 | 114 |
| Compressibility [%] | 21 | 14.5 |

Base powders F5 and F6 were mixed with other granular components as set out below and exhibited properties as specified:

| Ingredients [wt %] | C | 5 | 6 |
|---|---|---|---|
| F5 | 63.5 | | |
| F6 | | 55.3 | 55.3 |
| Granular sodium sulphate | 18.5 | 15.4 | 8.0 |
| Light sodium carbonate | 18 | 17.0 | 5.3 |
| A1 | | 12.3 | 31.4 |
| Surfactant level (% wt) | 24 | 25 | 40 |
| BD [g/l] | 471 | 550 | 497 |
| DFR [g/l] | 72 | 87 | 112 |
| Compressibility [%] | 15 | 13 | 16 |
| High comp. in base [%] | 100 | 18.2 | 36.2 |
| High comp. in total [%] | 63.5 | 12.3 | 31.4 |

The conventional composition C was prepared by using the relatively high-active base powder F5, which had a compressibility of 21%, and postdosing inorganic salts.

Composition 5, having a very similar overall composition but produced from the lower-active base powder F6 plus the very high active granule A1, shows clear improvements over the conventional composition C, especially with respect to flow. Composition 6 which is based on composition 5 but with a very large quantity of anionic surfactant, still has acceptable compressibility, and excellent flow.

Example 7

A zeolite built composition having primary alcohol sulphate (PAS) as the anionic surfactant was produced for comparison with Examples B and 4. To make this composition an additional component N3 was made by rerunning the process for making component N1 but using 23% by weight Imbentin 6.5EO (nonionic surfactant ex Kolb). Component N3 had a compressibility of 16%.

| Component | 7 |
|---|---|
| B3 | 46.5 |
| A2 | 22.4 |
| N3 | 18.1 |
| Light sodium carbonate | 7.3 |
| Antifoam granule[1] | 1.3 |
| $NaHCO_3$ | 3.9 |
| SCMC | 0.6 |
| Surfactant level (%) | 25.5 |
| BD (g/l) | 530 |
| DFR (ml/s) | 97 |
| Compressibility [%] | 6 |

[1]As in Example B

All components except for the antifoam granule were of low compressibility.

Example 8 to 10, Comparative Examples D to I

These Examples demonstrate the importance of compressibility and the significance of the 80% and 66% compressibility limits.

Detergent base powder F7 was spraydried by making a slurry of water, STP, NaLAS, nonionic and silicate. This slurry was spraydried in a countercurrent spraydrying tower, resulting in a powder with the following composition:

| Ingredient | F7 [wt %] |
|---|---|
| NaLAS | 27.06 |
| STP | 27.06 |
| $Na_2SO_4$ | 10.75 |
| Silicate | 21.87 |
| Minors, NDOM | 2.46 |
| Moisture | 10.80 |

Base powder F7 had a compressibility of 23%.

An anionic surfactant granule A4 was produced in a similar manner to A1, using a $2m^2$ VRV machine, to the following composition:

| Ingredient | A4 [wt %] |
|---|---|
| NaLAS | 70 |
| Zeolite 4A | 20 |
| Zeolite MAP | 5 |
| Sodium sulphate, NDOM | 3 |
| Moisture | 2 |

Component A4 had a compressibility of 12%.

A builder granule, B4, was prepared by continuously dosing STP in a Shugi Flexomix, while spraying on a 10% solution of alkaline silicate. The powder was subsequently cooled in a fluid bed. The resulting granule had the following composition:

| Ingredient | B4 [wt %] |
|---|---|
| STP | 89.3 |
| Sodium silicate | 1.8 |
| Moisture | 8.9 |

Component B4 had a compressibility of 7%.

With these base components and granular sodium carbonate, invention products 8, 9 and 10 and comparative products D to I were produced, as shown in the following table.

As can be seen, the invention products have excellent flows and compressibilities. It is clear that if 80% or more of the base powder consists of compressible material, the powder properties are relatively poor (compressibilities of 20% or above, DFR lower than 120). There is an intermediate area between 80 and 66% where properties are acceptable. Only at levels lower than 66% are the powder properties excellent (compressibility of 17% or below and DFRs above 130 ml/s)

| Ingredient [wt%] | D | E | F | G | H | I | 8 | 9 | 10 |
|---|---|---|---|---|---|---|---|---|---|
| B4 | | 3.6 | 5.8 | 7.9 | 9.4 | 11.5 | 13.3 | 15.2 | 18.2 |
| F7 | 100 | 88 | 81 | 74 | 69 | 62 | 56 | 50 | 40 |
| A4 | | 4.6 | 7.3 | 10.1 | 12 | 14.7 | 17 | 19.3 | 23.2 |
| Dense carbonate | | 3.8 | 5.9 | 8 | 9.6 | 11.8 | 13.7 | 15.5 | 18.6 |
| % base with comp. ≧ 17% | 100 | 91.5 | 86.1 | 80.4 | 76.3 | 70.3 | 64.9 | 59.2 | 49.1 |
| BD [g/l] | 325 | 398 | 419 | 460 | 463 | 500 | 520 | 542 | 584 |
| DFR [ml/s] | 101 | 113 | 114 | 115 | 121 | 123 | 131 | 134 | 136 |
| Compressibility [%] | 23 | 24 | 22 | 20 | 19 | 18 | 17 | 17 | 17 |

Example 11, Comparative Example J

LAS granules (component A5) containing 90% LAS, 7% zeolite MAP and 3% water and salts were made in the same way as described for component A1. Samples of 2–3 g LAS granules was added to a pre-weighed 70×40 mm crystallising dish. The sample was stored for 14 days in a climatic store at 37° C. and a relative humidity of 70%.

After storage the samples were assessed for their flow characteristics by agitating the crystallising dish gently and evaluating the flow on a 1–5 scale, 1 representing a totally free flowing sample, 5 a sample which was totally caked. Component A4 showed a caking tendency under the conditions used, resulting in scores of 4–5 after 14 days storage.

Base powder F8 was manufactured by spray-drying a slurry of STP, LAS, sodium sulphate and sodium silicate resulting in a powder with the following composition:

| Ingredients | F8 |
|---|---|
| STP | 18 |
| LAS | 29 |
| Sodium sulphate | 32 |
| Sodium silicate | 10 |
| Water, minors | 11 |

Builder granule B5 was manufactured by spray-drying a slurry of sodium sulphate, sodium carbonate, Sokalan CP5 (ex BASF) and water resulting in a powder containing 65.2% by weight sodium sulphate, 24.8% sodium carbonate and 10% Sokalan CP5.

The following full compositions were mixed:

| Ingredients [wt %] | J | 11 |
|---|---|---|
| Component F8 | 82.5 | |
| Component B5 | | 38.8 |
| Component A5 | | 26.7 |
| Component B1 | | 19.8 |
| Light soda ash | 17.5 | 8.5 |
| Granular sodium sulphate | | 6.2 |
| BD [g/l] | 342 | 523 |
| Compressibility [%] | 13 | 9 |
| High comp. in base [%] | 100 | 31.3 |
| High comp. in total [%] | 82.5 | 26.7 |

Approximately 300 g of each composition was put in a large rectangular open box such that a thin layer of powder with a thickness in the order of 1–2 cm was exposed to the atmosphere. The open boxes with powder were stored for 4 and 8 weeks in a climatic store at 37° C. and 70% relative humidity. After this storage period the powders were assessed for caking according to the score described before. The following results were found:

| Powder | J | 11 |
|---|---|---|
| Caking score [1–5] after 4 weeks | 2 | 1 |
| Caking score [1–5] after 8 weeks | 3 | 2 |

The results show that the compositions of the invention retain flow characteristics under conditions of higher humidity and temperature than conventional formulations as a result of the anionic surfactant being formulated in separate granules.

This Example thus illustrates a secondary benefit of the invention: products formulated according to the invention exhibit improved storage behaviour. Although the initial compressibilities of both Example 11 and Comparative Example J were good, Example 11 was better at retaining good powder properties on storage.

We claim:

1. A particulate detergent composition having a bulk density of 700 g/l or less and comprising at least 10 wt % of organic detergent surfactant, the composition comprising a base powder which contains detergency builder and organic detergent surfactant selected from the group consisting of anionic surfactants, nonionic surfactants and mixtures thereof and which consists of structured particles, characterized in that the base powder is composed of at least two different granular components, including:

(a) at least one granular component having an anionic surfactant content of 60 wt % or more, and (b) at least one granular component containing at least 70 wt % of builder material which is sodium tripolyphosphate and/or zeolite, and less than 5 wt % detergent surfactant, at least one of these granular components having a compressibility, measured at 20–25°C. and about 40% relative humidity, of less than 17%, whereby less than 80 wt % of the total base powder is constituted by a granular component or components having a compressibility of 17% or more.

2. A detergent composition as claimed in claim 1, wherein less than 66 wt % by weight of the base powder has a compressibility (measured at 20–25° C. and about 40% relative humidity) of 17% or more.

3. A detergent composition as claimed in claim 1, which contains at least 15 wt % of total detergent surfactant.

4. A detergent composition as claimed in claim 1, which contains at least 20 wt % of total detergent surfactant.

5. A detergent composition as claimed in claim 1, wherein a first granular component of the base powder has a compressibility of 17% or more and a second granular component of the base powder has a compressibility of less than 17%, the base powder containing less than 80 wt % of the first component.

6. A detergent composition as claimed in claim 5, wherein the base powder contains less than 66 wt % of the first component.

7. A detergent composition as claimed in claim 1, wherein less than 50 wt % of the base powder has a compressibility of 17% or more.

8. A detergent composition as claimed in claim 7, wherein less than 45 wt % of the base powder has a compressibility of 17% or more.

9. A detergent composition as claimed in claim 1, wherein the base powder further comprises granules containing at least 40 wt % of nonionic surfactant.

10. A detergent composition as claimed in claim 1, wherein the composition comprises a base powder in admixture with postdosed ingredients, wherein the composition contains less than 55% by weight, calculated on the whole composition, of material having a compressibility of 17% or more.

11. A detergent composition as claimed in claim 10, wherein the composition contains less than 45% by weight, calculated on the whole composition, of material having a compressibility of 17% or more.

12. A detergent composition as claimed in claim 10, wherein the composition contains less than 40% by weight, calculated on the whole composition, of material having a compressibility of 17% or more.

13. A detergent composition as claimed in claim 10, wherein the postdosed ingredients are selected from the group consisting of bleach ingredients, bleach precursors, bleach catalysts, bleach stabilisers, photobleaches, alkali metal carbonate, water-soluble crystalline and amorphous alkaline metal silicates, layered silicates, anti-redeposition agents, soil release polymers, dye transfer inhibitors, fluorescers, inorganic salts, foam control agents, foam boosters, proteolytic, lipolytic, amylitic and cellulytic enzymes, dyes, speckles, perfume, fabric conditioning compounds and mixtures thereof.

14. A detergent composition as claimed in claim 10, comprising at least 40 wt % by weight of base powder.

15. A process for manufacturing a particulate detergent composition as claimed in claim 1, comprising separately preparing granular components and dry-mixing the granular components.

* * * * *